US008414152B2

(12) United States Patent
Yen

(10) Patent No.: US 8,414,152 B2
(45) Date of Patent: Apr. 9, 2013

(54) LED HEAT-DISSIPATION STRUCTURE FOR MATRIX LED LAMP

(76) Inventor: Hsu Li Yen, Taipei County (TW)

( * ) Notice: Subject to any disclaimer, the term of this patent is extended or adjusted under 35 U.S.C. 154(b) by 88 days.

(21) Appl. No.: 13/083,662

(22) Filed: Apr. 11, 2011

(65) Prior Publication Data

US 2012/0255717 A1 Oct. 11, 2012

(51) Int. Cl.
*F21V 21/00* (2006.01)

(52) U.S. Cl.
USPC ..... 362/249.02; 362/294; 362/147; 362/148; 362/373

(58) Field of Classification Search ..... 362/362, 362/368, 373, 294, 148, 249.02
See application file for complete search history.

(56) References Cited

U.S. PATENT DOCUMENTS 6,454,439 B1 * 9/2002 Camarota ..... 362/293
7,866,850 B2 * 1/2011 Alexander et al. ..... 362/294

* cited by examiner

*Primary Examiner* — Ali Alavi
(74) *Attorney, Agent, or Firm* — Rosenberg, Klein & Lee

(57) ABSTRACT

An improved heat-dissipation structure for a matrix LED lamp is disclosed. The heat-dissipation structure is a plate-shaped metal hood configured to hold an LED matrix module for heat dissipation so as to maintain the entire matrix LED lamp cool. The heat-dissipation structure is a plate-shaped metal shell having a plurality of threaded holes allowing the LED matrix module to be fixed thereto. In virtue of the tight contact between the bottom of the LED matrix module and the plate-shaped metal hood, heat generated by the LED matrix module can be quickly absorbed and dissipated by the plate-shaped metal hood, so as to prevent the LED matrix module from premature aging, thereby enlightening the service life of the LED matrix module.

1 Claim, 1 Drawing Sheet

LED HEAT-DISSIPATION STRUCTURE FOR MATRIX LED LAMP

BACKGROUND OF THE INVENTION

1. Technical Field

The present invention relates to LED lamps, and more particularly, to an improved heat-dissipation structure for a matrix LED lamp.

2. Description of Related Art

Nowadays, various lamps are extensively used in our daily life for providing illumination. A lamp can be set at a desired site in a space and emit light to change the brightness in the space. Therefore, lighting devices are important to our life not only because they help to improve our quality of life, but also because the light they provide is highly related to human body and eye health.

Recently, the traditional lamps have been gradually replaced by modern LED matrix modules worldwide because LED matrix modules are more environmentally friendly and less harmful to human bodies while providing better brightness and stability as compared with the traditional lamps. In addition, LED matrix modules are less power-consuming, thus being an excellent lighting approach.

However, an LED matrix module tends to generate high heat when emitting light. An LED lamp with its lamp seat, housing and other components combined as a whole, as traditionally used, is likely to bring about premature aging of its LED matrix module (LED failure) for failing to dissipate heat generated by the LEDs. For heat dissipation, computer-controlled extruded aluminum heatsinks and electric fans are conventional schemes. However, these conventional schemes are adverse to either manufacturing costs or power consumption, going against the spirit of using LED matrix module instead of the traditional lamps to save power and costs.

In view that heat dissipation remains a problem to LED matrix lamps, the inventor of the present invention has paid attention to conduct research and development, and finally proposes a plate-shaped metal hood that can fast dissipate heat generated by an LED matrix module so as to maintain the LED matrix module cool, without increasing the manufacturing costs.

SUMMARY OF THE INVENTION

The present invention provides an improved heat-dissipation structure for a matrix LED lamp. The heat-dissipation structure is a plate-shaped metal hood configured to hold an LED matrix module so as to allow quick heat dissipation and maintain the entire matrix LED lamp cool. The heat-dissipation structure is a plate-shaped metal shell having a plurality of threaded holes allowing the LED matrix module to be fixed thereto. In virtue of the tight contact between the bottom of the LED matrix module and the plate-shaped metal hood, heat generated by the LED matrix module can be quickly absorbed and dissipated by the plate-shaped metal hood, so as to prevent the LED matrix module from premature aging, thereby enlightening the service life of the LED matrix module.

The primary objective of the present invention is to make the plate-shaped metal hood quickly absorb and dissipate the heat generated by the LED matrix module, so as to prevent the LED matrix module from premature aging, thereby enlightening the service life of the LED matrix module.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Figure 1:
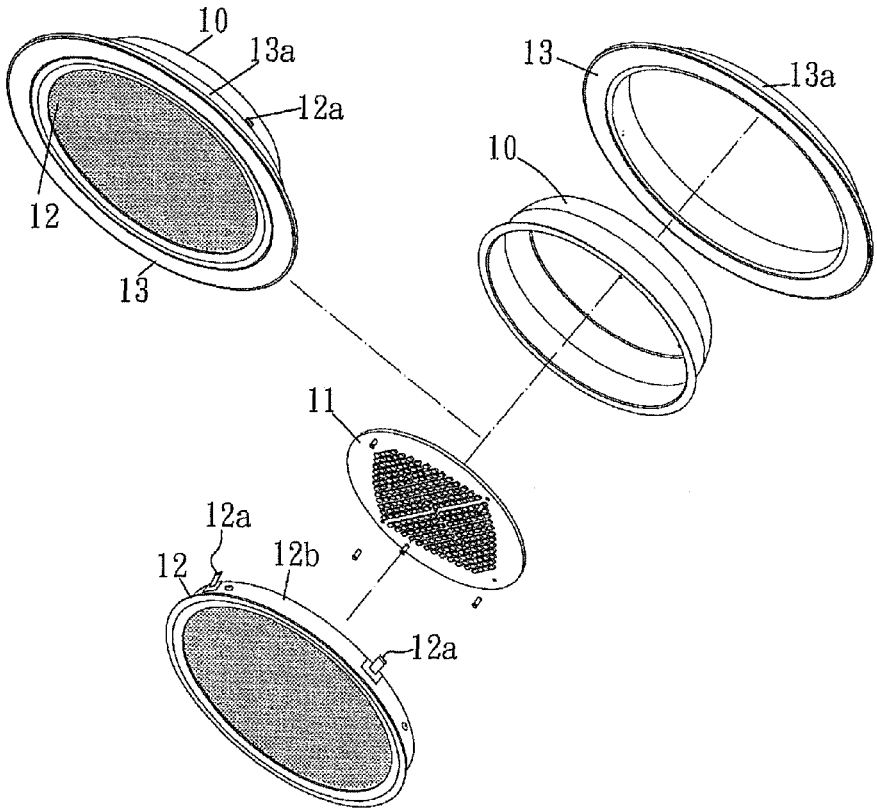
FIG. 1 is an exploded view of a matrix LED lamp with an improved heat-dissipation structure according to the present invention.
Figure 2:
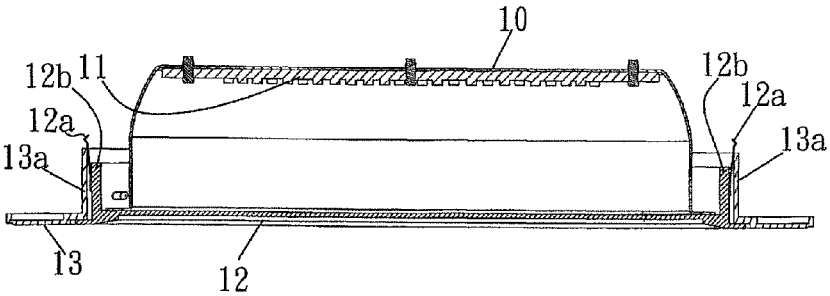
FIG. 2 is a cross-sectional view of the matrix LED lamp with the heat-dissipation structure as depicted in FIG. 1.

Referring to FIG. 1 and FIG. 2, in an exploded view and a cross-sectional view of a matrix LED lamp with an improved heat-dissipation structure according to the present invention, the heat-dissipation structure comprises primarily a plate-shaped metal hood 10, a light-pervious cover 12, and a fastening collar 13.

The plate-shaped metal hood 10 is a plate-shaped shell made of a metal material, having its inner side configured to hold an LED matrix module 11.

The light-pervious cover 12 has a peripheral wall 12*b*, on whose end surface a plurality of reeds 12*a* is provided. The peripheral wall 12*b* defines a space for receiving the plate-shaped metal hood 10. The plate-shaped metal hood 10 can be then nailed on the light-pervious cover 12 by rivets put on the peripheral wall 12*b* for preventing the light-pervious cover 12 and the plate-shaped metal hood 10 from separating.

The fastening collar 13 also has a peripheral wall 13*a* defining a space centrally to receive the light-pervious cover 12 by fitting the peripheral wall 12*b* so that the reeds 12*a* prop against the peripheral wall 13*a* of the fastening collar 13 to fasten the light-pervious cover 12 to the fastening collar 13.

The plate-shaped metal hood 10 has its inner side combined with the LED matrix module 11, so that the bottom of the LED matrix module 11 is in tight contact with the plate-shaped metal hood 10. Thereby, heat generated by the lighted LED matrix module 11 can be fully absorbed by the plate-shaped metal hood 10 and quickly transferred to the outer surface of the plate-shaped metal hood 10, to be dissipated in the ambient atmosphere.

Thereby, the present invention indeed contributes to rapid heat dissipation and is novel as such design has never seen in the art, thus being patentable.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An improved heat-dissipation structure for a matrix LED lamp, the improved heat-dissipation structure comprising:

a plate-shaped metal hood forming a plate-shaped shell made of a metal material and defining a recessed inner side surface extending contiguously thereacross, the recessed inner side surface being configured in contour to receive an LED matrix module substantially in peripheral alignment thereon;

a light-pervious cover having a peripheral wall and a plurality of reeds provided thereon, the peripheral wall defining a space for receiving the plate-shaped metal hood, the plate-shaped metal hood placed therein being fastened to the peripheral wall of the light pervious cover for preventing the light-pervious cover and the plate-shaped metal hood from separating; and a fastening collar having a peripheral wall defining a space centrally to receive the light-pervious cover, the reeds engaging the peripheral wall of the fastening collar to fasten the light-pervious cover to the fastening collar, wherein the plate-shaped metal hood receives the LED matrix module, a bottom of the LED matrix module fitted in peripheral contour within the plate-shaped metal hood substantially covering said recessed inner side surface in conformed manner, heat generated by the LED matrix module in operation being thereby substantially absorbed by the metal material of the plate-shaped metal hood and transferred to an outer surface of the plate-shaped metal hood, whereby the matrix LED lamp is cooled by the ambient environment.

* * * * *